United States Patent [19]

Breen

[11] Patent Number: 5,054,629

[45] Date of Patent: Oct. 8, 1991

[54] ADJUSTABLE TRAY RISER

[75] Inventor: John D. Breen, Wooster, Ohio

[73] Assignee: Rubbermaid Incorporated, Wooster, Ohio

[21] Appl. No.: 563,652

[22] Filed: Aug. 6, 1990

[51] Int. Cl.[5] ..... A47B 47/04

[52] U.S. Cl. ..... 211/128; 211/194

[58] Field of Search ..... 211/126, 188, 194, 128, 211/183

[56] References Cited

U.S. PATENT DOCUMENTS

| | | | |
|---|---|---|---|
| D. 188,832 | 9/1960 | Staebell . | |
| D. 261,904 | 11/1981 | Polhemus . | |
| 1,352,490 | 9/1920 | Wilkins | 211/183 X |
| 4,074,810 | 2/1978 | Juergens et al. . | |
| 4,785,939 | 11/1988 | Huerto et al. . | |
| 4,907,703 | 3/1990 | Alger et al. . | |

FOREIGN PATENT DOCUMENTS

| | | | |
|---|---|---|---|
| 1550076 | 3/1969 | France | 211/126 |

OTHER PUBLICATIONS

Pp. 22, 23, 24 and 27, Eldon Office Products, P.O. Box 22667, Long Beach, California 90801-5667, Publication date Jan., 1990.

P. 9, Eldon Office Products, P.O. Box 22667, Long Beach, California, 90801-5667, Publication date unknown.

Pp. 4, 5 and 6, Rubbermaid Commercial Products Inc., 3124 Valley Ave., Winchester, Virgnia 22601, Publication date 1986.

Pp. 6 and 8, MacDonald Products Corp., 2685 Walden Ave., Buffalo, New York 14225, Publication date unknown.

Catalog Page, Park Sherman, a Division of Ketcham & McDougall Inc., 465 Eagle Rock Avenue, Roseland, New Jersey 07068, publication date unknown.

*Primary Examiner*—Carl D. Friedman
*Assistant Examiner*—Derek J. Berger
*Attorney, Agent, or Firm*—Richard B. O'Planick

[57] ABSTRACT

An adjustable support riser for vertically stacking letter trays is disclosed, comprising a riser body (10) having a lower clothespin type attachment configuration (30, 32, 42) for securing to a lower letter tray, and an upper attachment socket (12) for attaching to a downwardly projecting (52) foot projection of an upper letter tray, whereby the upper and lower letter trays are in a spaced apart orientation. The upper attachment socket is provided with an elongate ovular shape of enlarged dimension, whereby the upper tray can selectively placed in either a forward or a rearward socket location relative to the upper end of the riser. The orientation of the upper letter tray relative to the lower letter tray can thereby be selectively altered from a parallel and co-aligned configuration to a staggered or stepped configuration. The lower attachment means of each riser is provided with offset cantilevered fingers (30, 32, 42), which distribute stress along the line of attachment to the lower letter tray. A reinforcement flange (40) is provided to extend along each cantilevered inward finger, whereby adding rigidity and strength to the lower attachment point.

22 Claims, 7 Drawing Sheets

ADJUSTABLE TRAY RISER

BACKGROUND OF THE INVENTION

1. Field of the Invention

The subject invention relates generally to risers for stacking letter trays, and specifically to an adjustable support riser for stacking letter trays into alternate relative alignments.

2. The Prior Art

Stacking letter trays in an office environment are in widespread use. Typically such systems comprise at least two letter trays which are separated by at least two molded plastic risers, each of which having a lower end adapted to attach to a lower tray, and an upper end adapted to attach to a like-configured upper tray. Commercially available risers generally comprise an elongate body having a clothespin type clamping configuration at a lower end for affixing to the side wall of the lower tray. The riser furthermore comprises a socket at an upper end which is upwardly open. Letter trays to be used in the system provide a downwardly directed foot projection at each corner, whereby receivable into four risers spaced at the corners of the underlying tray.

Pursuant to the above state of the art risers, the upper tray fixedly attaches to the upper end of four support risers, which are in turn spaced along the sidewalls of the underlying tray, whereby the upper and lower trays are in parallel spaced apart co-alignment. A riser and tray system of the type described above is commercially available, for example such a system is sold by Rubbermaid Incorporated, Office Products Division, 1147 Akron Road, Wooster, Ohio 44691, under letter tray part no. 2131 and riser part no. 2132.

While the above letter tray and riser system works well, and has been generally well accepted in the trade, several shortcomings prevent the system from achieving the ideal objectives of the end user. First, the clothespin type attachment of the lower end of the riser to the upper side wall edge of the lower tray is subject to breakage because of the fragile plastic material, and because lateral stress introduced into the stacking tray configuration places stress into the clamping clothespin fingers of the lower end of the riser. Because both fingers of the clamping end are rather elongate, and narrow in width dimension, it is not uncommon for breakage to occur at this point of the riser.

Secondly, a shortcoming in conventional risers exists in the fact that the attachment between the upper end of the riser and the upper letter tray is fixed, and that a longitudinal realignment of the upper tray with regard to the lower tray cannot be effectuated. Therefore, a staggered tray stacking configuration is not achievable by means of adjusting the upper tray relative to the lower tray. The utility of existing riser and letter tray systems is therefore limited.

SUMMARY OF THE INVENTION

The present invention comprises an adjustable support riser for vertically stacking letter trays. The riser body has a lower clothespin type attachment configuration for securing to a lower letter tray, and an upper attachment socket for attaching to a downward projecting foot projection of an upper letter tray, whereby the upper and lower trays are in a spaced apart stacked orientation. The upper attachment socket is provided with an elongate ovular shape of enlarged dimension, whereby the upper tray can be selectively placed in either a forward or a rearward socket location relative to the upper end of the riser. Thus, the orientation of the upper letter tray relative to the lower letter tray can be selectively altered from a parallel and co-aligned configuration to a staggered or stepped configuration.

Additionally, the lower attachment end of the riser comprises an offset, or staggered, clothespin type clamp which is affixable to the sidewall of the lower letter tray. The offset configuration of the clamping fingers provides a distribution of stress along the line of attachment, and by decentralizing the stress distribution, minimizes breakage at this point. Further, the inwardly disposed fingers of the lower riser end are shortened relative to the outer finger to provide greater strength and resistance to breakage. A longitudinally extending reinforcement flange is further provided to enhance the structural rigidity of the inwardly disposed clamping fingers, to further assist in deterring breakage.

Accordingly, it is an objective of the present invention to provide a riser for stacking letter trays having an integral tray adjustment capability.

Yet a further objective is to provide a riser for stacking letter trays having independently readjustable upper and lower tray adjustment means.

Still a further objective of the present invention is to provide a riser for stacking letter trays having laterally adjustable, reinforced clamping means for attaching to a sidewall of a letter tray.

Yet a further objective of the present invention is to provide a riser for stacking letter tray having improved, reinforced means for clamping to a sidewall of a letter tray.

A further objective of the present invention is to provide a riser for stacking letter trays which is integrally molded, having adjustable tray alignment means at upper and lower ends, capable of being manufactured conventionally from plastics material.

These and other objectives, which will be apparent to those skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF PREFERRED EMBODIMENT

Figure 1:
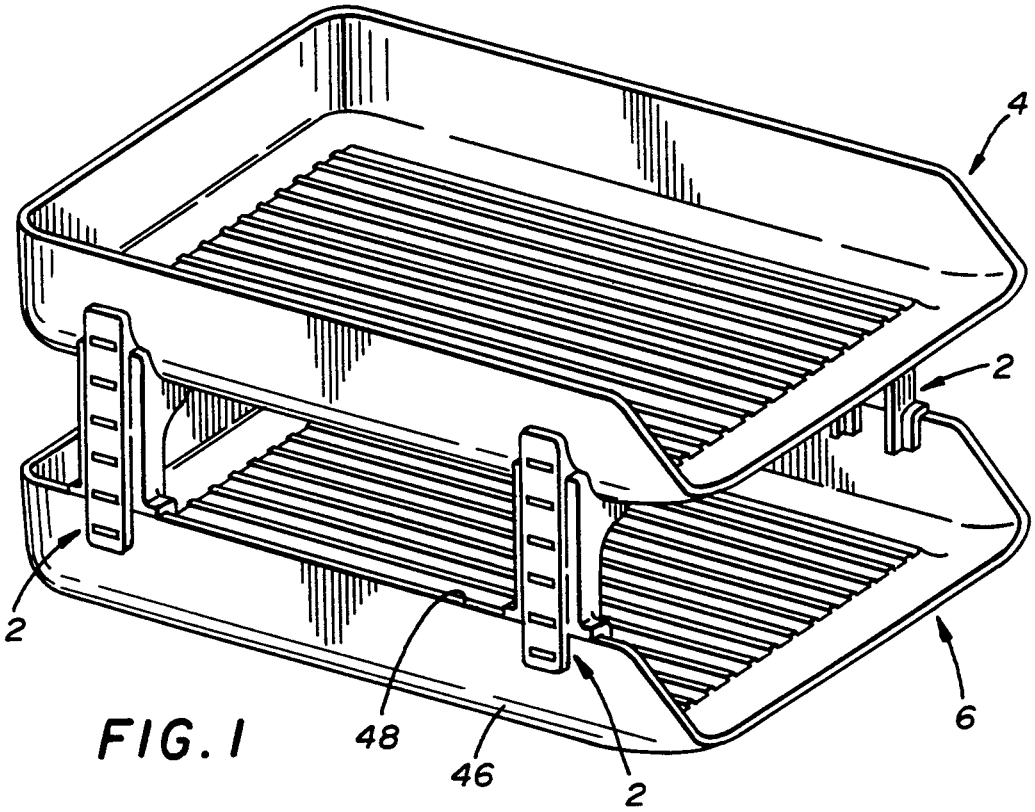
FIG. 1 is an assembled perspective view of two stacking letter trays, spaced apart and supported by four risers configured pursuant to the subject invention.
Figure 2:
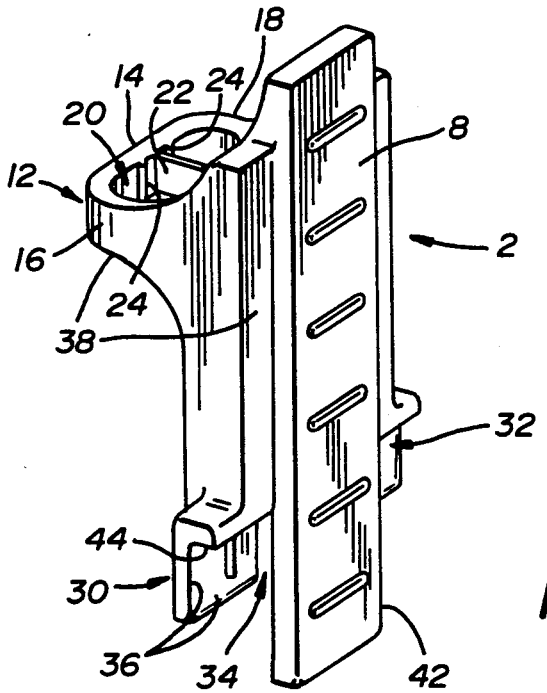
FIG. 2 is a front perspective view of the subject riser.
Figure 4:
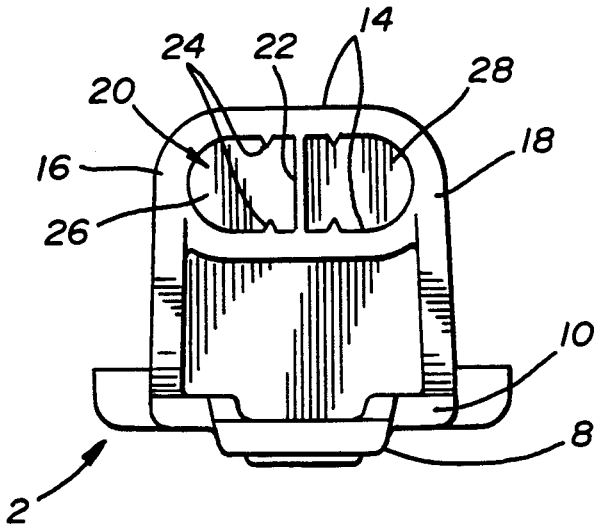
FIG. 4 is a top plan view of the subject riser.

Referring first to FIGS. 1, 2, and 4, the subject riser and letter tray system is shown to comprise four risers 2, an upper tray 4, and a lower tray 6. Each component 2, 4, 6 is conventionally injection molded of common plastics material. The riser 2 comprises an elongate, generally rectangular flange 8 which is stepped outward from an elongate central body 10. At the top of the riser 2 is an upwardly open socket portion 12. The socket 12 is molded to provide sidewalls 14 enclosed by endwalls 16, 18. It will be appreciated that socket 12 is generally elongate and ovular, for a purpose explained below.

Socket sidewalls 14 and endwalls 16, 18 define an internal cavity 20 which opens upwardly. Cavity 20 is bifurcated by a barrier wall 22 which extends from one sidewall 14 to the other. A plurality of raised ridges 24 are molded integrally with the sidewalls 14, to extend into the cavity 20 for a purpose explained below. Due to the presence of barrier wall 22, cavity 20 is divided into two equal cavity portions 26, 28.

Figure 5:
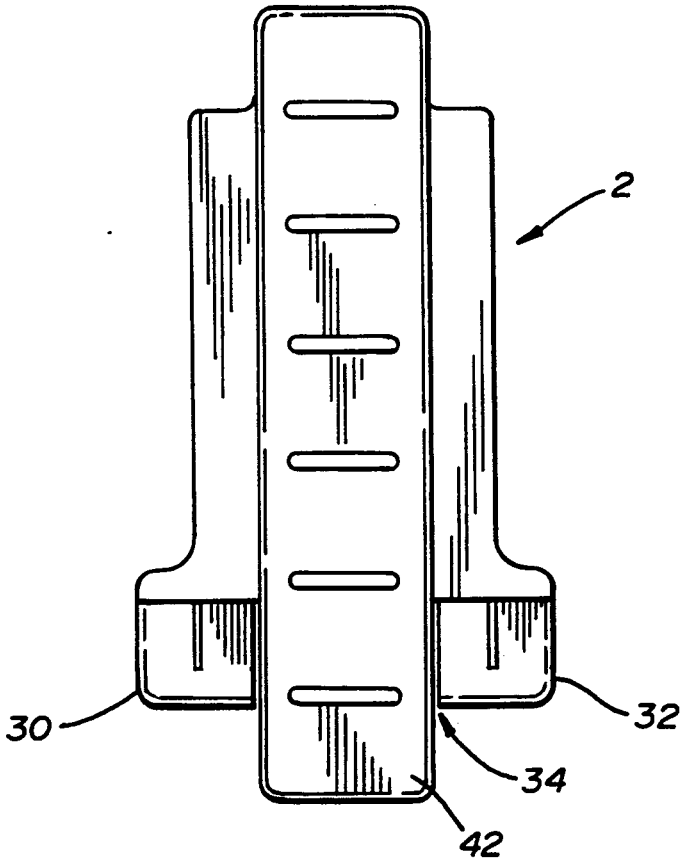
FIG. 5 is a front elevation view of the riser.
Figure 6:
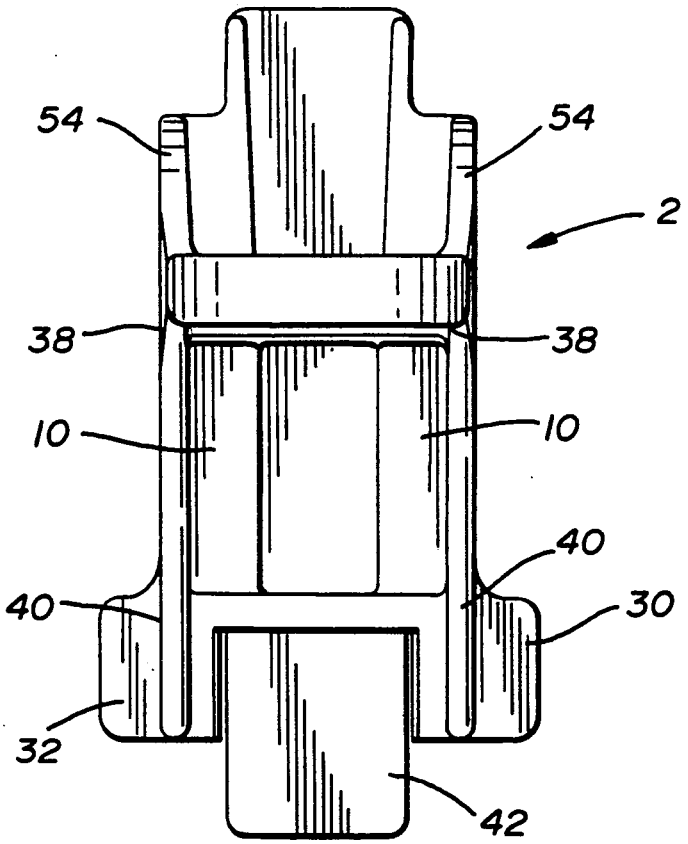
FIG. 6 is a rear elevation view of the riser.
Figure 7:
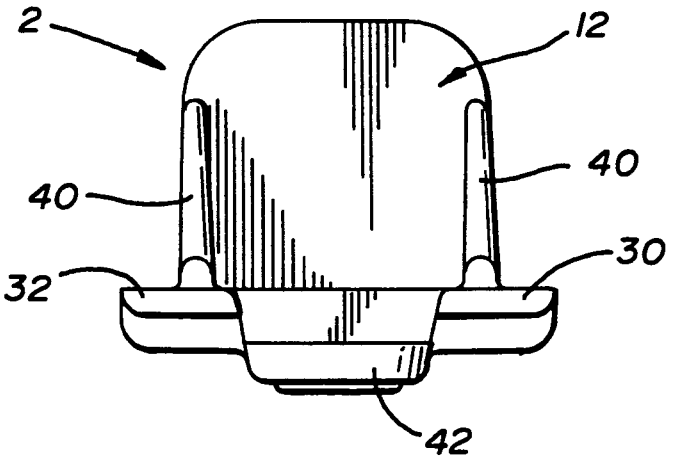
FIG. 7 is a bottom plan view of the riser.

Proceeding to a consideration of FIGS. 2, 5, and 6, the riser 2 further comprises a downwardly directed first inward cantilevered finger flange 30, and a second inward cantilever finger flange 32 which are laterally separated by an opening 34. It will be appreciated that the finger flanges 30, 32 are generally square in configuration, and extend outwardly from the central body block 10 as shown best in FIG. 6.

Figure 8:
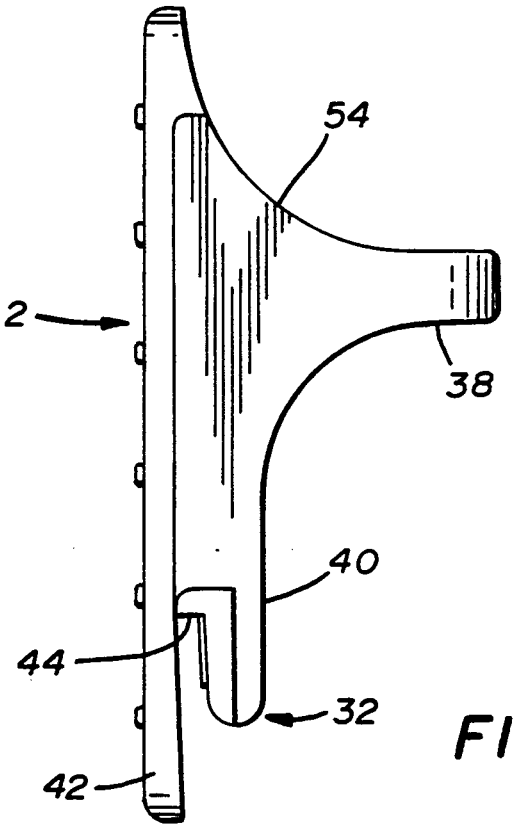
FIG. 8 is a side elevational view of the subject riser.
Figure 9:
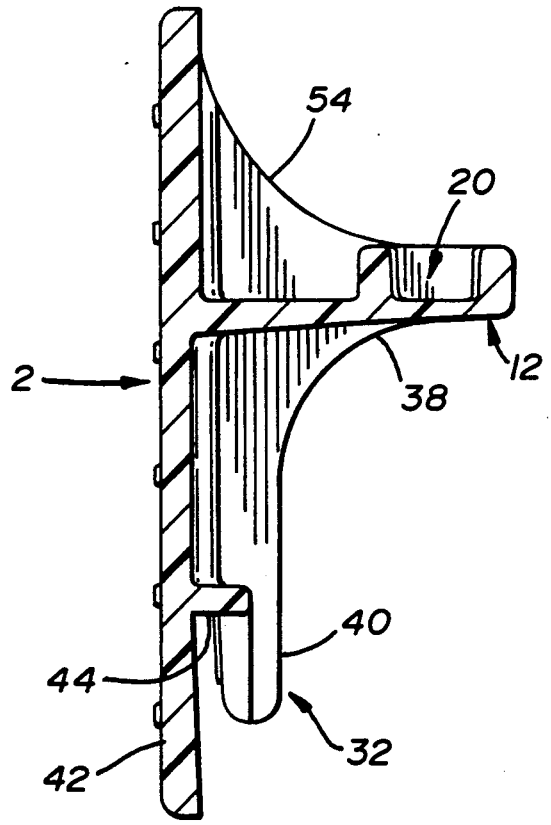
FIG. 9 is a longitudinal sectional view through the subject riser, taken along the line 9—9 of FIG. 8.

With continued reference to FIGS. 6, 8, and 9, each socket endwall has a lower edge 38 which is arcuately convex in configuration, and which extends downwardly to form a reinforcement flange 40. Each reinforcement flange 40 continues downwardly along the outside surface of one of the inward cantilevered finger flanges 30, 32, until terminating at a lower edge thereof. Reinforcement flanges 40 serve to structurally strengthen the cantilevered finger flanges 30, 32, in order to minimize breakage during use.

FIGS. 1, 2, 8, and 9 illustrate an outward cantilevered finger flange 42, which extends downwardly from body flange 8. The outward cantilevered finger flange 42 is generally rectangular in plan, and defines, with the inward cantilever finger flanges 30, 32, a bight surface portion 44. It will be apparent that the outward cantilever finger 42 and inward cantilevered finger flanges 30, 32 define therebetween an inverted U-shaped clamp capable of affixing the lower riser end to the sidewall of a lower letter tray. It will further be readily apparent that the outward cantilevered finger flange 42 is offset from the inward cantilever finger flanges 30, 32, generally opposite to the separation spacing 34, and on the longitudinal centerline of the riser. The staggered arrangement of finger flanges 30, 32 and 40 serves to distribute stress forces during use along a wider area then the conventional narrow clothespin style risers. So distributed, the stress forces are less likely to cause breakage of finger flanges 30, 32, or 42 when the riser is in use.

Figure 3:
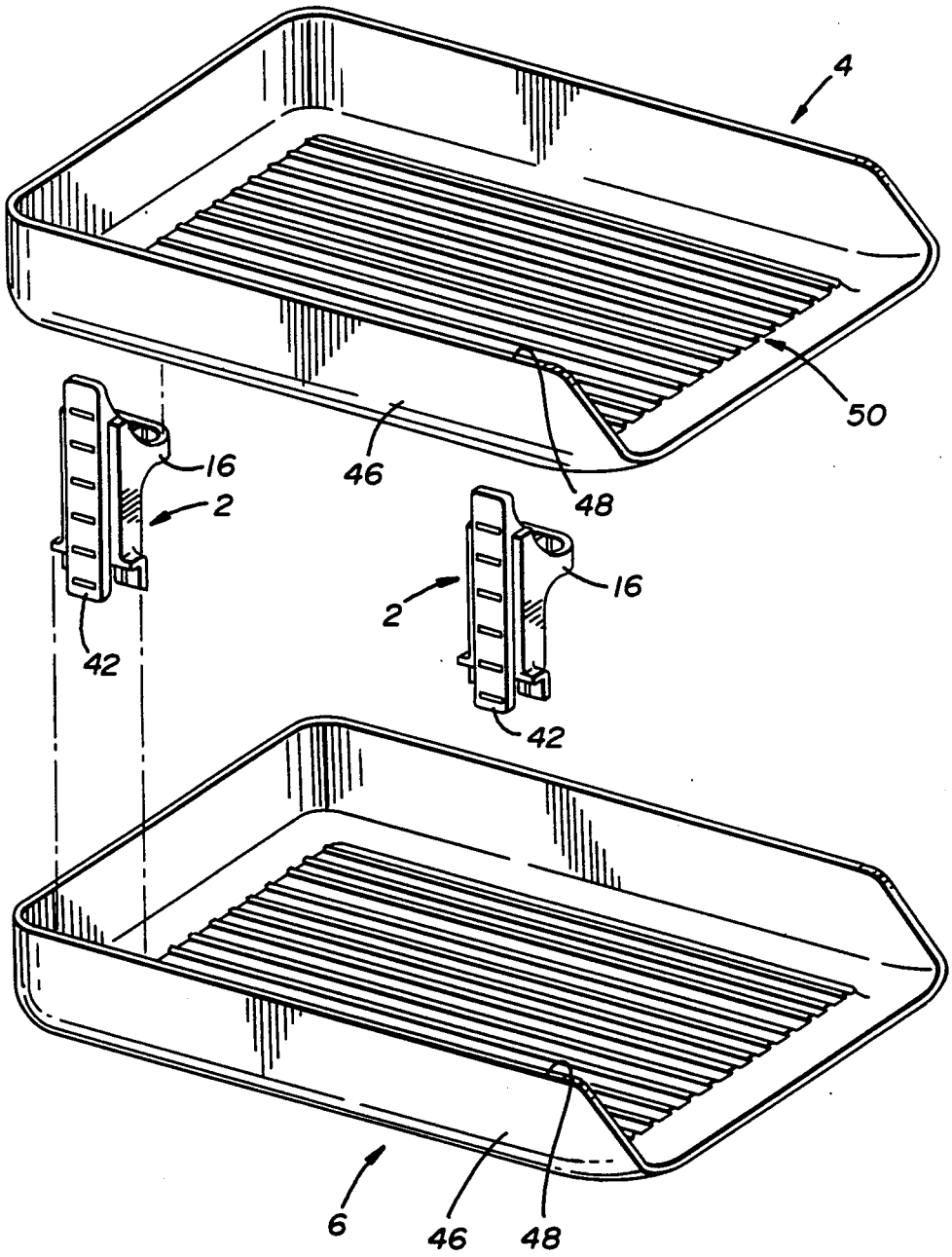
FIG. 3 is an exploded perspective view of two letter trays, and two of the four risers to be used therewith.

As shown in FIGS. 1, 3, 12, and 13, the upper and lower letter trays 4, 6 are identically configured, each having up-raised sidewalls 46, terminating at an upper edge 48. A paper receiving surface 50 is defined therebetween as shown in FIG. 3. At each corner of the underside of each letter tray 4, 6 is a downwardly extending, generally circular, foot projection 52. Foot projection 52, as will be readily apparent from the following description of the operation of the subject system, is dimensioned for receipt into one of the two cavity portions 26, 28 of the riser 2.

The top edge 54 of the riser socket 12, as shown in FIGS. 1, 8, and 9, is upwardly concave and generally complements the curvature of the sidewalls 46 of letter trays 4, 6. A nest is created between the curvature of top edge 54 of each riser and the lower curvature of each sidewall 46 as the upper tray is mounted to 4 risers appropriately positioned at the corners of the lower tray 6.

Figure 12:
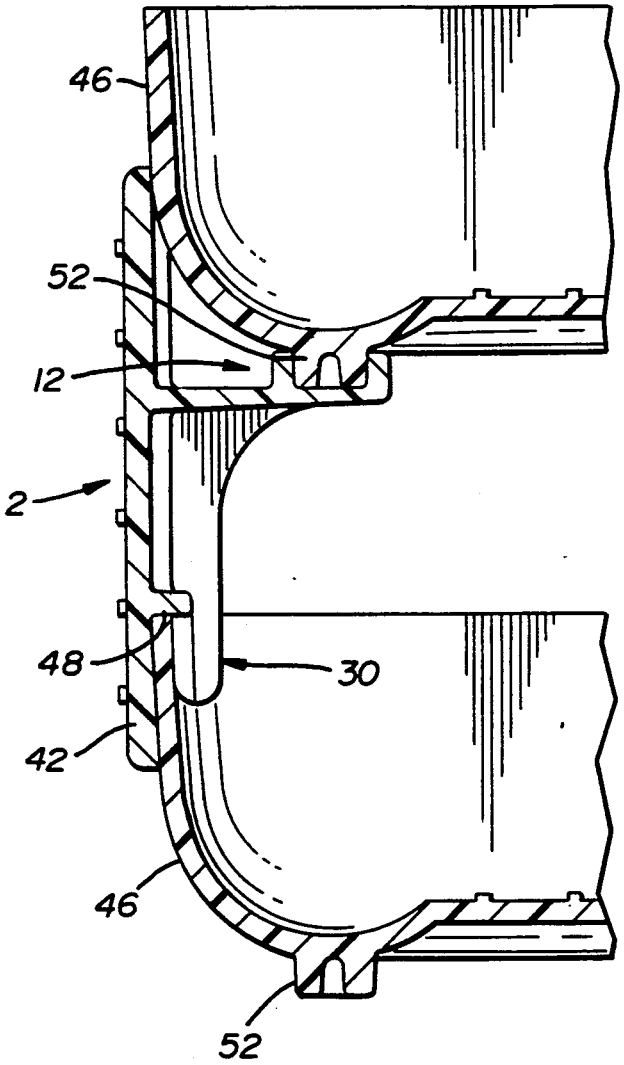
FIG. 12 is a sectional view through the stacked letter trays and riser, taken along the line 12—12 of FIG. 10.
Figure 13:
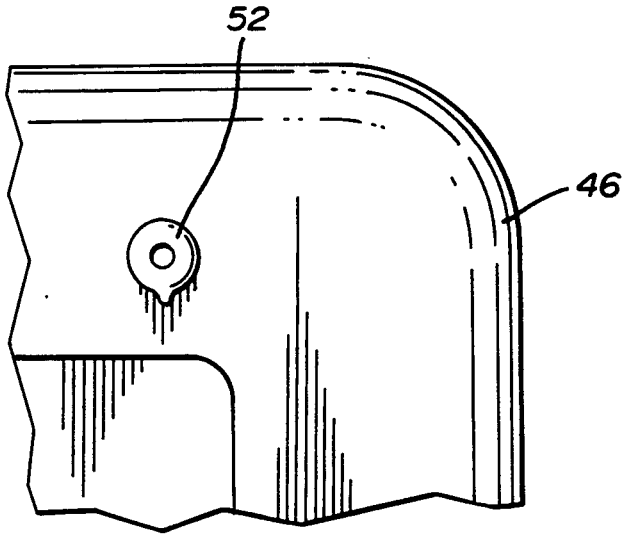
FIG. 13 is a bottom plan view of a corner of one of the letter trays, taken along the line 13—13 of FIG. 10.

Referring to FIGS. 1, 3, and 12, assembly of the subject riser and letter tray system proceeds as follows. Four risers 2 are mounted to the upper edge 48 of the sidewalls 46 of lower tray 6 as upper edge 48 receives each riser's clamping lower attachment. Insertion of the sidewall 46 between the outward cantilever finger flange 42 and the inward cantilever finger flanges 30, 32 terminates when upper edge 48 abuts the bight surface portion 48.

The location of each riser 2 with respect to the lower letter tray 6 is determined by visual inspection. The risers typically are located symmetrically about the center line of sidewalls 46. It will be appreciated from FIG. 12 that the inward cantilever finger flanges 30, 32 are of shorter length than the outer cantilever finger flange 42. The shorter length enhances the rigidity of inward flanges 30, 32, and thereby makes them less susceptible to breakage when stacked letter trays are laterally flexed. In addition, the staggered arrangement of flange 42 relative to flange 30, 32 serves to distribute the stress forces along a wider area of the letter tray sidewall 46. This deconcentration of stress force serves to likewise minimize breakage of flanges 42 and 30, 32 during use. It will be apparent that the position of the risers 2 along the lower tray sidewalls 46 can be varied so long as the spacing between the risers remains suitable to receive the foot projections of the upper tray.

With continued reference to FIGS. 1, 3, and 12, the upper letter tray 4 is thereafter brought into engagement with the four risers 2 which have been preaffixed to the sidewalls 46 of lower letter tray 6. Alternatively, if so desired, the assembly sequence can be reversed by first pre-attaching risers 2 to the upper letter tray 4, and thereafter assembling the risers to the sidewalls 46 of lower letter tray 6.

Figure 10:
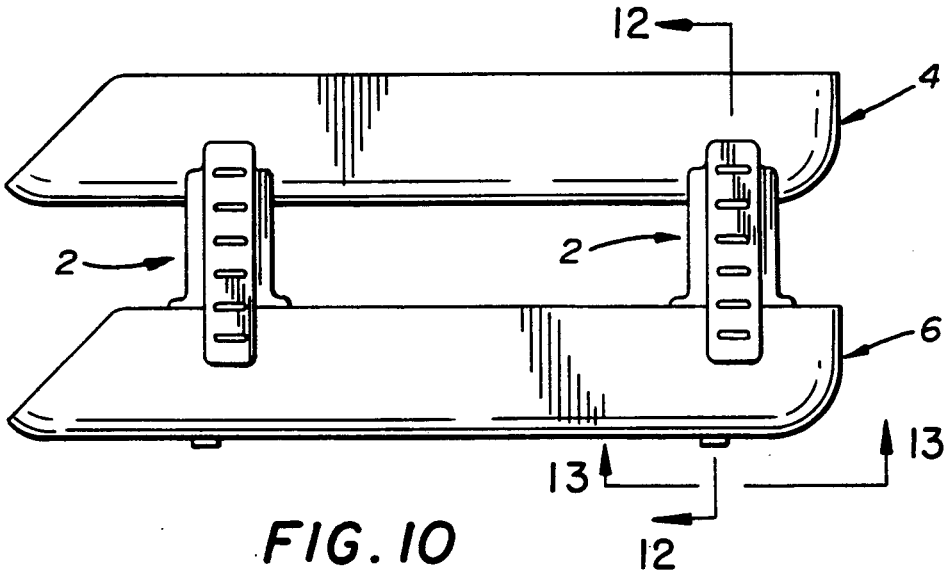
FIG. 10 is a side elevation view of a system comprising two letter trays and the risers of the subject invention, with the letter trays shown in a stacked and square configuration.

As will be appreciated, the foot projection 52 at each corner of the underside of each letter tray is adapted to be closely received into one of the cavity portions 26, 28 of socket cavity 12. The ridges 24 establish an interference fit between the sidewalls of the cavity 12 and the foot projections 52. The orientation between the upper letter tray 4 and the lower letter tray 6 can be alternately varied by the selection of either one of cavity portions 26, 28 of risers 2. For example, if a square, aligned stacking configuration is desired, the foot projections 52 are inserted into the forwardmost cavity portions, whereby a forward edge of the top tray 4 is co-planar with the forward edge of the lower tray 6 as shown in FIG. 10.

Figure 11:
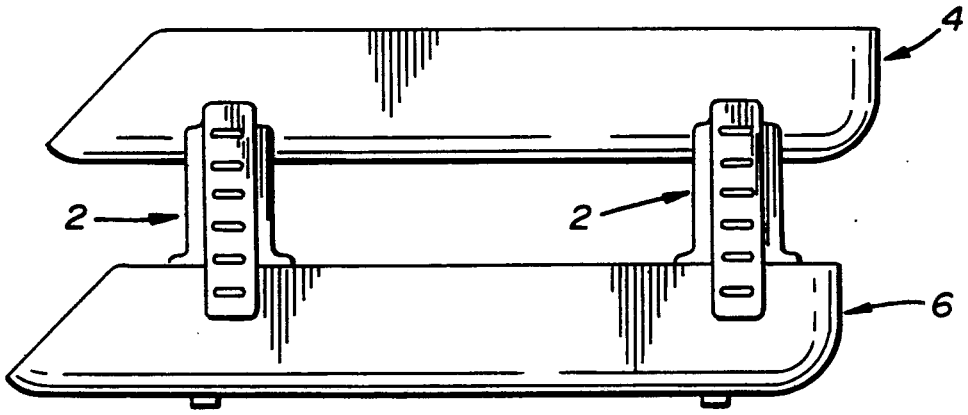
FIG. 11 is a side elevational view of the tray and riser system with the trays shown in a staggered or stepped configuration.

Alternatively, if so desired, the orientation and alignment between the upper and lower letter trays can be changed to that shown in FIG. 11 by removal of the foot projections 52 of the upper letter tray, and moving the projections backwardly into the rearwardmost cavity portion of each riser 2. The staggered, or stepped configuration shown in FIG. 11 exposes the lower letter tray 6 to a greater extent than the square or co-aligned configuration of FIG. 10, making it easier to insert paper into the lower tray. It should be appreciated from FIGS. 10 and 11 that the change in orientation can be effectuated without changing the center line positionment or spacing of the lower ends of risers 2 with respect to the lower letter tray 6. It will further be appreciated that the relative orientation of the top letter tray to the lower letter tray can therefore be modified by either, or both, the top riser attachment structure or the bottom riser attachment structure.

Accordingly, the subject invention provides a stacking letter tray and riser system which comprises a riser having integrally molded tray orientation and adjustment means at both the upper and lower attachment points. Additionally, the riser attachment flanges 30, 32 at the lower end are structurally reinforced by their shortened length, and by the presence of reinforcement flanges 40 as shown in FIG. 6. The structural reinforcement creates a riser which has greater strength and resistivity to breakage during normal use. Still further, the subject riser comprises a lower attachment point consisting of offset and laterally staggered flange projections 30, 32, and 42, which distribute stress forces over a wider area, thereby eliminating concentration of forces which could cause breakage of the flanges from the main body.

While the above describes a preferred embodiment of the subject invention, the present invention is not to be so restricted. Other embodiments, which will be apparent to one skilled in the art, and which utilize the teachings herein setforth, are intended to be within the scope and spirit of the present invention.

I claim:

1. An adjustable stacking letter tray system, comprising:

upper and lower letter trays, said trays having longitudinally extending sidewalls and said upper letter tray having at least one profiled protrusion projecting downwardly from a bottom surface;

at least one riser body having lower attachment means for securing to a longitudinally extending sidewall of said lower letter tray, and upper attachment means for receiving said upper tray protrusion, whereby attaching to said upper letter tray and placing said upper and lower trays in a spaced apart orientation, and said upper attachment means having adjustment means for selectively placing said upper letter tray in alternate longitudinal alignments relative to said lower letter tray with said riser lower attachment means remaining in a fixed location along said lower tray sidewall.

2. A stacking letter tray system as set forth in claim 1, wherein said upper attachment means comprising an upwardly open socket adapted to receive downwardly therein said downwardly directed profiled protrusion extending from said upper letter tray, the socket having at least two longitudinally adjacent, mutually exclusive regions in which the protrusion may alternately lie.

3. A stacking letter tray system according to claim 2, said socket being defined by elongate sidewalls which terminate at a top socket opening.

4. A stacking letter tray system according to claim 3, said socket having transverse barrier means for defining said two longitudinally adjacent socket regions.

5. A stacking letter tray system according to claim 4, said barrier means comprising a transverse wall extending between said socket sidewalls.

6. A stacking letter tray system according to claim 5, said upper tray protrusion comprising a profiled boss selectively receivable within said socket in either of said socket regions.

7. A stacking letter tray system according to claim 6, said socket being further defined by end walls extending between said socket sidewalls, and said socket side and end walls having an upper edge profiled complementary with an underside profile of said upper tray.

8. A stacking letter tray system according to claim 7 or 1, said lower tray having upright side walls, and said lower riser attachment means engaging an upper edge of said lower tray sidewalls and being repositionable therealong, whereby selectively altering said alignment between said lower and said upper trays.

9. A stacking letter tray system according to claim 8, said lower riser attachment means comprising inward and outward finger flange means spaced apart to closely receive said upper edge of said lower tray sidewall therebetween, said inward and outward finger means having opposed parallel surfaces extending parallel to, and being repositionable along, said upper edge of said lower tray sidewall.

10. A stacking letter tray system according to claim 9, said inward and outward finger flange means being offset with respect to each other.

11. A stacking letter tray system according to claim 10, said inward finger flange means comprising first and second inward cantilevered fingers laterally separated by a prescribed opening.

12. A stacking letter tray system according to claim 11, said outward finger flange means comprising an outward cantilevered finger positioned substantially opposite said prescribed opening between said outward first and second inward cantilevered fingers.

13. A stacking letter tray system according to claim 12, wherein upper ends of said inward first and second cantilevered fingers and said outward cantilevered finger being joined by a bight surface adapted to engage against said upper edge of said lower tray sidewall.

14. A stacking letter tray system according to claim 13 wherein said inward first and second cantilevered fingers being shorter than said outward cantilevered finger.

15. An adjustable stacking letter tray system, comprising:

upper and lower letter trays, each having longitudinally extending sidewalls and said upper tray having at least one profiled protrusion extending downwardly from a bottom surface thereof;

a riser body having lower attachment means for securing to a lower letter tray, and upper attachment means for attaching to an upper letter tray, whereby said upper and lower trays being in a spaced apart orientation, and said lower attachment means comprising dependent inward and outward cantilevered finger means, said inward and outward finger means having opposed parallel surfaces, said parallel surfaces being longitudinally offset and spaced apart to receive therebetween an upper edge of a sidewall of said lower letter tray, whereupon said riser parallel surfaces extending parallel to said upper edge of said lower tray and being repositionable longitudinally therealong.

16. A stacking letter tray system according to claim 15, said inward finger flange means comprising first and second inward cantilevered fingers laterally separated by an opening.

17. A riser according to claim 16, said outward finger flange means comprising an outward cantilevered finger positioned substantially opposite said opening.

18. A stacking letter tray system according to claim 17, said inward first and second cantilevered fingers having a shorter length than said outward cantilevered finger.

19. A stacking letter tray system according to claim 17, wherein upper ends of said inward first and second cantilevered fingers and said outward cantilevered finger being joined by a bight surface adapted for supportive engagement against said upper edge of said lower tray sidewall, 20. A stacking letter tray system according to claim 19, said upper attachment means comprising an upwardly open socket adapted to receive a complementary downward boss projection extending from said upper tray.

21. A stacking letter tray system according to claim 20, said socket being defined by sidewalls and end walls having an upper edge profiled to complement an underside profile of said upper tray.

22. A stacking letter tray system according to claim 21, said socket end walls having lower edges adapted to define downwardly directed ribs which extend along said riser body and outward surfaces of said first and second cantilevered fingers.

* * * * *